US005826708A

United States Patent [19]

Finlay

[11] Patent Number: 5,826,708

[45] Date of Patent: Oct. 27, 1998

[54] BACKLIGHTED DOME SWITCH ASSEMBLY

[75] Inventor: Ronald Kenneth Finlay, Ajax, Canada

[73] Assignee: Invotronics Manufacturing, Scarborough, Canada

[21] Appl. No.: 790,211

[22] Filed: Jan. 29, 1997

[51] Int. Cl.[6] ..... H01H 9/00

[52] U.S. Cl. ..... 200/314; 200/313

[58] Field of Search ..... 200/314, 313, 200/310, 512, 520

[56] References Cited

U.S. PATENT DOCUMENTS

| | | | |
|---|---|---|---|
| 4,343,975 | 8/1982 | Sado . | |
| 4,449,024 | 5/1984 | Stracener . | |
| 4,551,598 | 11/1985 | Hamilton et al. . | |
| 4,636,593 | 1/1987 | Novak et al. . | |
| 4,677,268 | 6/1987 | Nemeth et al. . | |
| 4,683,359 | 7/1987 | Wojtanek . | |
| 4,772,769 | 9/1988 | Shumate | 200/314 |
| 4,882,581 | 11/1989 | Inobe et al. . | |
| 4,885,443 | 12/1989 | Simcoe et al. . | |
| 5,140,116 | 8/1992 | Schmitt-Walter . | |
| 5,280,145 | 1/1994 | Moaier et al. | 200/314 |
| 5,471,023 | 11/1995 | Kaizu et al. . | |
| 5,477,430 | 12/1995 | La Rose . | |
| 5,491,313 | 2/1996 | Bartley et al. . | |
| 5,500,497 | 3/1996 | Merriman . | |
| 5,510,782 | 4/1996 | Norris et al. . | |
| 5,512,718 | 4/1996 | Larose | 200/314 |
| 5,521,345 | 5/1996 | Wulc . | |
| 5,568,367 | 10/1996 | Park | 200/314 |

*Primary Examiner*—David J. Walczak
*Attorney, Agent, or Firm*—Pennie & Edmonds LLP

[57] ABSTRACT

A silicone dome switch assembly including a printed circuit board on which is mounted a dome member having a chimney structure. The chimney structure has a substantially rigid upper portion, a collapsible wall below the upper portion, and a substantially rigid lower portion. A vertically aligned contact post is connected at its top end to the upper pportion. The post's bottom end of the post is provided with a movable electrical contact. A light duct connects a light source to the lower portion and a reflector is attached to the post to deflect light from the light source up into the chimney. A key having a graphic area formed on it, is secured to the rigid upper portion, thus capping the chimney structure. When the key is pressed, it pushes downward the rigid upper portion, causing the collapsible wall to deform. This action pushes the contact post with the carbon pill towards the printed circuit board, completing an electrical circuit. The assembly may have multiple chimneys, each having a separate light duct.

26 Claims, 2 Drawing Sheets

BACKLIGHTED DOME SWITCH ASSEMBLY

BACKGROUND

The present invention relates to backlighted membrane dome switch assemblies. More specifically, it concerns the structure of such assemblies in which light is reflected up towards the keys pushed by a user. Such assemblies can be used to activate controls in a motor vehicle, on a keyboard, and in other settings, as well.

Backlighted silicone dome switch assemblies are well-known in the prior art. In current designs, a silicone dome switch array is provided with a plurality of movable contacts, referred to as carbon pills, each embedded in a silicone keytop. The contacts are suspended above a printed circuit board (PCB) by a flexible wall of silicone rubber. The wall is often angled or tapered such that when pressure is applied to the keytop, the flexible wall collapses. This allows a contact to touch the PCB, completing an electrical circuit.

Typically, a dome switch assembly having one or more keys is mounted on a PCB. The surface of the PCB board is provided with a pair of spaced apart fixed contacts. When a key on the silicone dome is pressed, a movable contact in communication with that key touches both of the fixed contacts, thus completing a circuit.

To provide backlighting, current designs may include walls, or light dams, of silicone around keys to confine the light emanating from a centralized light source and/or deflectors that reflect light traveling along the surface of the silicone mat up into the inside of the keys.

Backlighting may also be provided by positioning a lamp or other light source on or beneath the PCB on which the dome switch assembly is mounted. In such case, the light is ported through an opening in the PCB to the keys. Such an arrangement is shown in U.S. Pat. No. 5,521,345 to Wulc. As the lamp need not be placed on the upper side of the PCB, (i.e., the side on which the fixed contacts are formed,) the dome switch array can be made with a low profile. However, this is disadvantageous from the standpoint of manufacturability, lamp installation, and serviceability.

As an alternative to placing the lamp below the PCB, one may place it about the PCB and form the keys around the lamp. This type of arrangement is shown in U.S. Pat. No. 4,885,443 to Simcoe, et al. In such assemblies, each key is given a dedicated lamp. The disadvantage is that when one has multiple keys, multiple lamps must be provided. Not surprisingly, this adds to the manufacturing cost and decreases the reliability of such an assembly, as each lamp may be subject to failure.

As an alternative to having a lamp under each key, a single lamp may be positioned between two or more such keys, its light illuminating a plurality of keys. Such an arrangement is found in U.S. Pat. No. 4,636,593 to Novak, et al. In this reference, an array of keys, is illuminated by lamps placed at junctures where four keys meet. The light in this case passes through the translucent keypad, illuminating the entire assembly rather than just the keys.

An alternative to placing a lamp under or among the keys is to place the lamp on the PCB away from the keys. In such case, the light is ducted through a light tunnel or light pipe and then reflected upwards to the keys. Such an arrangement is found in U.S. Pat. No. 5,280,145 to Mosier, et al. In this reference, a pyramidal reflector is positioned on the PCB underneath the key. The top of the reflector is operatively engaged to a translucent elastomeric member. The translucent member, in turn, is connected to the top of the keypad.

When a key is pressed, the translucent member underneath the key also moves downward. This pushes against the top portion of the reflecting member. As a consequence, a movable contact formed within the reflecting member is pushed downward to complete a contact between two members mounted on the PCB. This arrangement is unnecessarily complex and expensive as it requires a number of independent components.

In addition to the backlighting feature, dome switches also must insure that a reliable electrical contact is completed each time a key is pushed. This can be done in a number of ways. Most often, a post or other member is suspended from the key. When the key is pushed, the post moves towards the PCB. A carbon pill affixed to the bottom of the post then touches the PCB completing an electrical contact.

Upon removal of key selection pressure, the key returns to its original position. This can be brought about by a spring action or an elastic deformation of the material comprising the key. U.S. Pat. No. 4,667,268 to Memeth, et al., is an example of a key which experiences an elastic snap transformation in the course of connecting a carbon pill formed on the bottom of a post to fixed contacts formed on a PCB. This design, however, does not readily accommodate a light source which can illuminate the keytop from below.

SUMMARY OF THE INVENTION

The present invention provides a silicone dome switch array having a passage for transmitting light from a lamp mounted on a PCB. Each key on the dome switch is operatively engaged to a contact post to which a carbon pill is affixed for completing an electrical circuit on the PCB. A reflector is mounted on the post and serves to divert light from a light source upwards to illuminate the underside of a key having a translucent graphic area formed on a top surface thereof.

The dome switch is preferably formed as a single piece of silicone and each key is mounted on a chimney structure of the switch assembly. The chimney structure itself comprises a substantially rigid upper portion, a collapsible portion attached to the bottom of the upper portion, and a substantially rigid lower portion attached to the bottom of the collapsible portion. The contact post is vertically oriented, with its upper end being fixed to the upper portion of the chimney structure.

The lower portion of the chimney, from the mat to a point above the light duct, is substantially rigid. From there, the collapsible wall is formed and after that, moving upwards, the chimney becomes substantially rigid once again to the height of the key. With this arrangement, the collapsing is not done at the mat level, but rather at an elevation which allows the light duct to remain intact. In the absence of such a design, the collapsing action of the collapsible wall would close off the path of light and the graphic area would dim when a key is pressed.

When a key is pressed, it depresses the upper portion, causing the collapsible portion to deform. This allows the post and the carbon pill attached thereto to move in a downward direction, completing the electrical contact. The reflector mounted on the post continues to divert light towards the underside of the pressed key as the collapsible portion is deformed. This allows the keytop to remain illuminated as the key is pushed.

A light duct, which is connected to the lower portion of the chimney structure, conveys lights from a light source to the reflector. Thus, the light source need not be positioned under the key. This allows for a dome switch with multiple chimney structures, each of which is connected to a light duct, with the light ducts converging at the light source. In this manner, a single light source can illuminate a number of keys, the illumination not being dimmed when any key is pressed.

The present invention is most easily adapted for groups of two or more button switch assemblies in which the light is contained in the ducts and can exit only the opaque silicone through specific graphic areas formed in the top surface of the keys. In this regard, the present design embodies a silicone mat that may almost completely cover the PCB. Four ducts intersect with individual vertical chimneys representing the location and approximating the size and shape of the keys. While internal flooding of light would cause light to shine out of the top of the chimney, a reflector is incorporated in each chimney to improve the efficiency of the light transmission. An angled face of silicone is formed on the far side of each chimney such that it intersects the beam of light from the duct and redirects it upward to the graphic area of the key to be illuminated. The keys, usually formed from hard plastic, fit over the their respective chimneys and are sealed by a circumferential rib formed on the upper portion of the chimney structure, with a complementary feature formed on the inside perimeter of the key. Behind each reflector and formed as part of the inside corner of the chimney is a post to carry the actuation force to the carbon pill.

BRIEF DESCRIPTION OF THE DRAWINGS

These and other features, aspects, and advantages of the present invention can be seen in the drawings where.

DESCRIPTION OF THE PREFERRED EMBODIMENT

Figure 1:
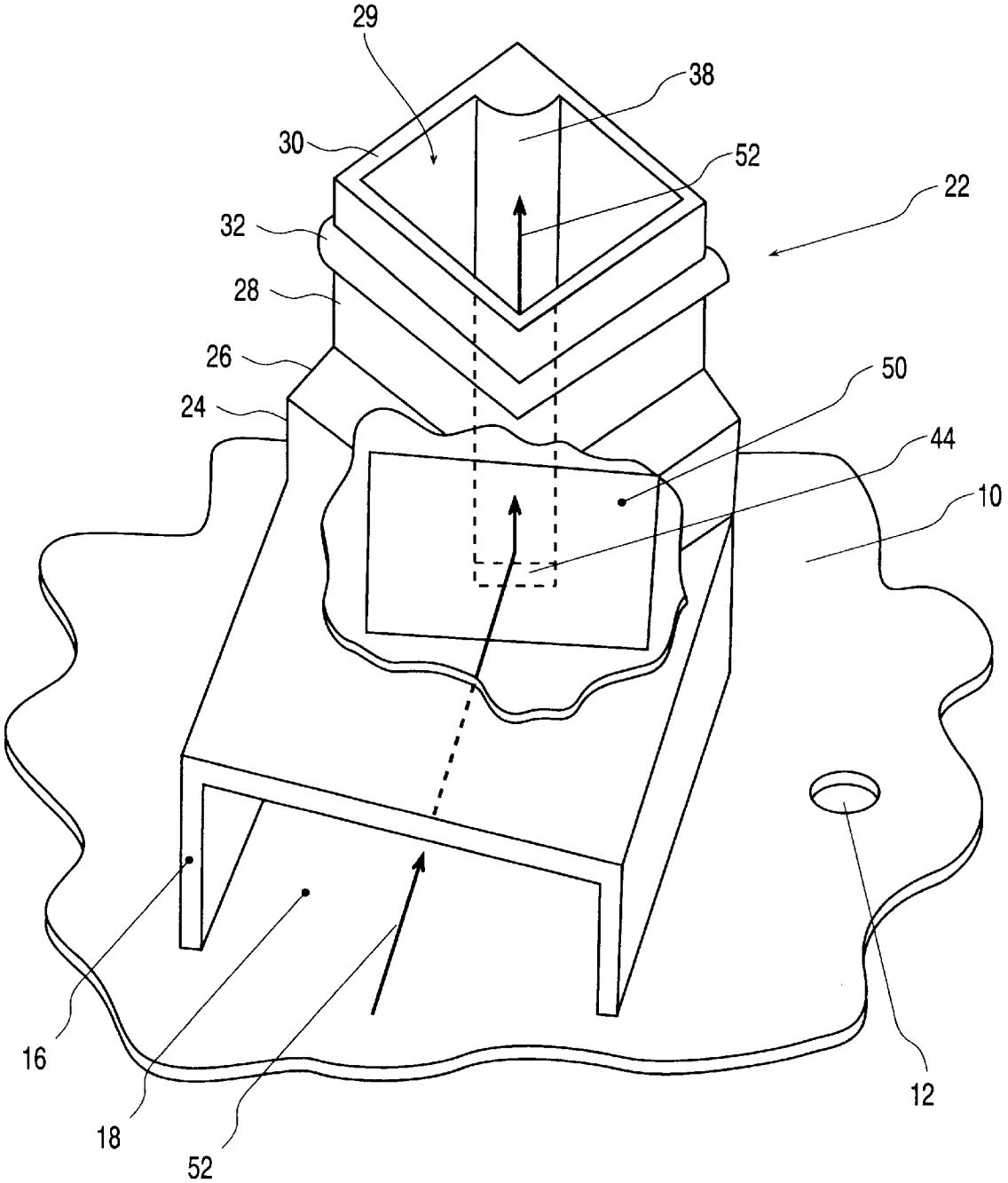
FIG. 1 is a perspective view of a silicone dome switch in accordance with the present invention.

As shown in FIG. 1, a silicon mat (10) is provided with one or more locating holes (12) to mount the mat onto a printed circuit board (14) PCB. Thus, the silicone mat (10) completely covers the PCB outside the region covered by a raised, hollow light duct (16). Alternatively, the silicone mat may form the floor of the duct, covering substantially all of the PCB within the duct, except for those sections carrying pairs of spaced apart electrical contacts which are closed by activation of the dome switch. The mat may also be provided with wrap-around edges to further protect the PCB.

The light duct (16), which is formed from silicone, is shown in FIG. 1 to have a rectangular cross-section. Instead, the light duct may have a triangular shape or an arch shape, with the PCB forming the bottom surface of the duct. Also, instead of a duct, a light pipe formed as a tubular piece of plastic or rubber, or the like, may be used. It should be kept in mind that the purpose of the light duct, or equivalent, is to provide a light duct volume (18) for conveying light.

Figure 3:
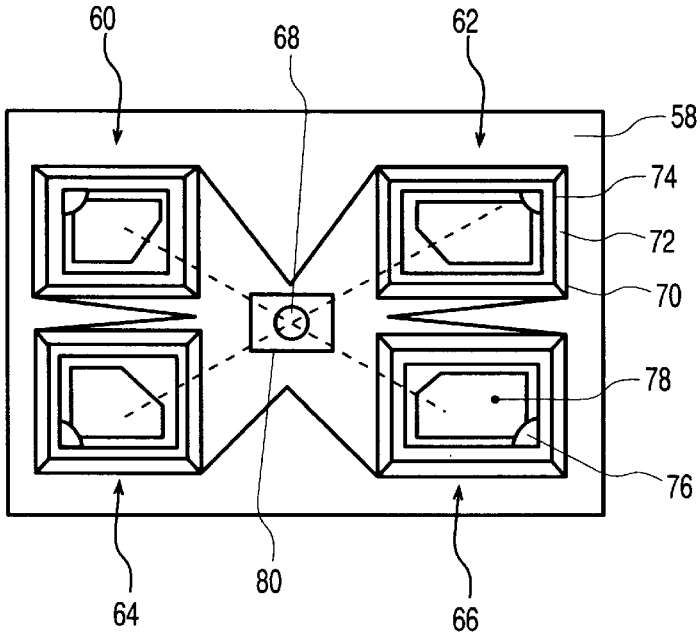
FIG. 3 is a top view of a silicone dome switch in accordance with the present invention having a plurality of chimney structures.

Typically the light duct (16) extends from a lamp (20) to a chimney structure (22). The chimney structure of FIG. 1 is shown with a rectangular or square shaped cross-section. However, the cross-section of the chimney structure can take a circular or oval shape, as well. Also, in FIG. 1, only one duct and one chimney structure is shown. However, in general, a single lamp may provide illumination for several such ducts and chimney structures. For instance, two, three, four and even more such ducts and chimney structures may be located about a single lamp. In such case, they may be spaced about the lamp, symmetrically or non-symmetrically, with each chimney structure having a dedicated light duct, the ducts converging together at the lamp. Alternatively, multiple chimney structures may share a single lamp with little or no light ducts, especially when the chimney structures share a common lower portion and are oriented in different directions, as shown in FIG. 3.

In the preferred embodiment of FIG. 1, the chimney structure (22) is provided stepped walls. A substantially rigid lower wall (24) is provided atop the light duct (16). The lower wall is connected to a collapsible wall (26) which extends inwardly, slightly narrowing the perimeter of the chimney structure. However, the collapsible wall (26) may instead flare in an outward direction from the lower wall, or may even just be vertically aligned with the lower wall, although these arrangements are less preferred.

The other end of the collapsible wall is connected to a substantially rigid upper wall (28). Thus, lower (24) and upper (28) walls are substantially parallel to one another, both preferably extending in a vertical direction relative to the silicone mat. It should be kept in mind, however, that the walls forming the chimney structure may just as easily be angled with respect to the PCB, and with respect to each other. The important property is that they are provided with both rigid and collapsible walls, one of which deforms, and the other of which does not, when the rigid wall is depressed, i.e., pushed in the direction of the collapsible wall, and thus towards the PCB.

Figure 2:
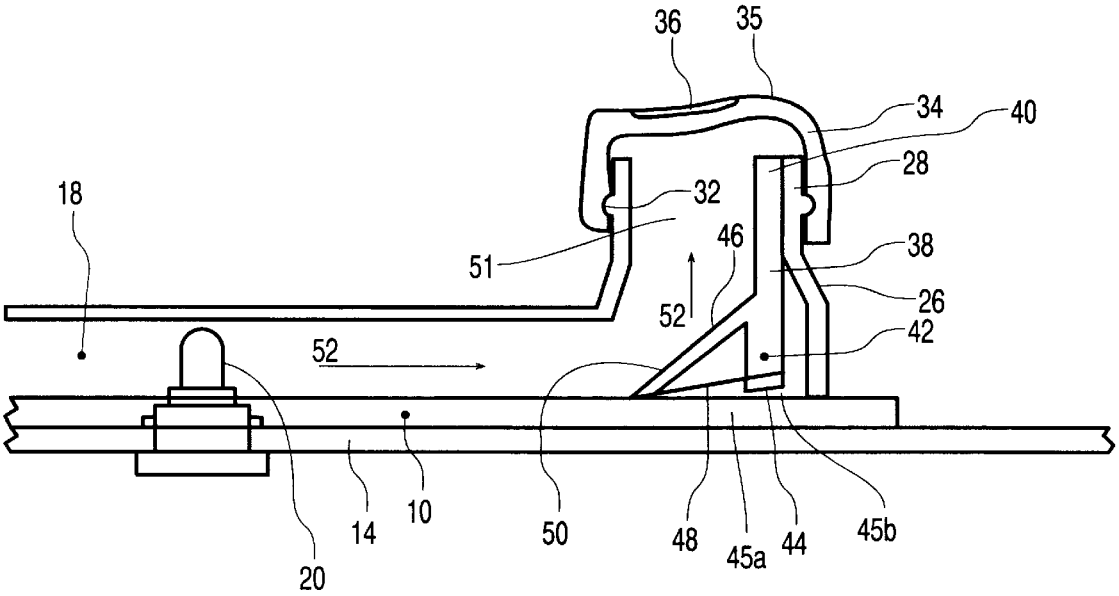
FIG. 2 is a cross-sectional view of the silicone dome switch of FIG. 1.

The chimney structure 22 terminates in an opening (29) formed at the top end (30) of the upper wall (28). Just below the top (30) of the upper wall, and formed on its outside surface, is a circumferential rib (32) which serves as a button snap. Preferably, the circumferential rib (32) is integrally formed with the upper wall. Its purpose is to provide a bead around which a button or key (34), formed with a complementary concave formation on an inside surface thereof, may be secured, as shown in FIG. 2. It should be noted, however, that other means such as snaps, hooks, and the like can also be used to secure the button (34) to the top (30) of the upper wall (28).

Button (34) is typically formed from plastic. However, as is known to those skilled in the art, rubber, mylar, and other materials may also be used. On its top surface (35), button (34) is provided with a graphic area (36). Unlike the body of the dome switch, which is usually opaque, the graphic area (36) is translucent. This allows one to see light through the graphic area (36) when the button is illuminated from below. Most often the graphic area (36) comprises one or more letters or symbols representative of the function provided by pushing the button (34). This allows one to determine the function of each button, even at night time, so long as light from a light source is deflected by the reflector (50) up into the chimney structure (22), as indicated by the arrows (52) in FIG. 1.

Attached to the upper wall (28), on the inside of the chimney (22), is a contact post (38). Contact post (38) is connected at its upper, or first, end (40) to the upper wall (28). Contact post's (38) lower, or second, end (42) ends just above the PCB (14). At its lower end (42) contact post (38) is provided with a carbon pill (44), which serves as an electrical contact forming means. When the button (34) is pressed, the collapsible wall (26) gives way, depressing the upper wall (28) and causing the contact post (38) to move in a downward direction towards the PCB (14). As the contact post descends, the carbon pill (44) contacts the PCB completing an electrical circuit between a pair of spaced apart electrical contacts 45*a,* 45*b* provided thereon.

U.S. Pat. No. 4,677,268, whose contents are incorporated by reference, discloses an arrangement in which an electrical contact means completes a connection between a pair of spaced apart contacts formed on a PCB. And although the preferred embodiment uses a carbon pill (44), the electrical contact forming means can also be formed as a pushing member, not unlike the switch actuating portion 36 disclosed in aforementioned U.S. Pat. No. 5,280,145, whose contents are also incorporated by reference. In such case, the pair of spaced apart contacts formed on the PCB would comprise a deformable contact, which is pushed into a fixed contact by the pushing member to complete an electrical connection.

The contact post (38) is prevented from significant lateral movement by means of a first support member (46). First support member (46) is attached at it upper, or first, end to a point between the upper and lower ends of the contact post (38). At its lower, or second, end, first support member (46) is anchored to the PCB. Alternatively the lower end of first support member (46) may be anchored to a portion of the light duct or the silicone mat instead.

Further structural rigidity is imparted to the contact post via a second support member (48). Second support member (48) extends between the lower end of first support member (46) and the lower end (42) of the contact post (38). It should be noted here that, instead of the two separate support members (46) and (48), a solid triangular shaped member may be integrally formed with the lower portion of the contact post, anchoring it to either the PCB or the silicone mat.

Formed atop the first support member (46) is a reflector (50). Reflector (50) deflects light (52) from the lamp in a upward direction through a passage (51) extending along the upper portion of the chimney structure, past the opening (29) and towards a graphic area (36). Thus, when the button is not pushed, first support member (46) is preferably at a 45° angle. It should be noted, however, that if the chimney (22) is not perpendicular to the PCB, then the support member would not be at exactly a 45° angle. When the button is pushed, the angle of the support member, and hence, the angle of the reflector as well, changes slightly. However, it does not change by such a large amount that light will still not be deflected towards the graphic area. The net result from this arrangement is that whether or not the button is pushed, the graphic area (36) remains illuminated from below. This contrasts with prior art devices in which light dams and other arrangements prevent light from being transmitted through a graphic area when the button is pushed.

FIG. 3 shows an embodiment of an assembly having a mat (58) atop which four such chimneys (60), (62), (64), (66) are formed. Each of the chimney structures receives illumination from a single lamp (68). Each of these chimneys has a substantially rigid lower wall (70), a collapsible wall (72) attached to an upper portion of the lower wall, and a substantially rigid upper wall (74) attached to an upper portion of the collapsible wall. Each chimney is also provided with an actuator post (76) and a reflector (78) attached to the actuator post (76), much as shown in FIG. 2. Also, as shown in FIG. 3, a sealable opening (80) formed from a flap of silicone may be provided above the light source (68) to facilitate maintenance of the light source.

In the embodiment of FIG. 3, the light source is seen to be positioned at the base of the four chimney structures, and in close proximity to all of them. Here, the chimney structures are angled away from the light source, rather than being perfectly vertical. It should be evident, however, that the light source (68) could be positioned farther away from each of the chimney structures, with light ducts extending from each of the reflectors and converging together at the light source (68).

In the above arrangement, the collapsible wall (26 or 72) preferably is formed from a material which gives the user tactile feedback. That is, the user should know when the collapsible wall has given way, and this should happen concomitantly with the carbon pill (44) completing the electrical circuit between the pair of spaced apart contacts.

The silicone dome switch array of the present invention preferably is formed by injection molding techniques, known to those skilled in the art. Thus, the wall thickness in the collapsible wall is thinner than that found on either side of it due the reduced spacing between the two molds halves in that region. The mold halves include a pair of complementary formations to form the contact post. Before the silicone is poured, the carbon pill is inserted into the female member of the pair of complementary formations. When the silicone is injected and sets, it surrounds a stem formed on the carbon pill, thus fixedly retaining the latter. Alternatively, the contact post may be formed as a separate member and then fixed to the substantially rigid upper wall on the inside of the chimney with the use of conventional adhesives, or the other equivalent fixing means.

The present invention simplifies the design, manufacture and assembly of dome switches. Together, these provide a number of advantages. First, the present design reduces the number of steps required to make the parts, simplifies the tooling necessary to manufacture the dome switch assembly, and reduces problems due to fit.

Second, the lateral stability of the silicone precludes the need for guide ribs or channels in the plastic parts as in normal switch designs. This eliminates the need for close tolerances, draft angle constraints on fit quality, lubrication concerns and the like. This is especially important when a housing cover overlays a dome switch assembly. With the present invention, the housing cover can be a simple surface having holes for the buttons to project through.

Third, the dome switch of the present invention can be formed as a single piece of silicone, exclusive of the keys. This speeds assembly and improves manufacturability. Further assembly advantages can be realized by forming the top portion (30) of the upper rigid wall (28) with a bevel to eliminate polarization problems, i.e., inverted keys, during assembly.

Fourth, during manufacture, the stability of the silicone substrate precludes button rattle, allowing one to first install the keys on the upper walls of the chimney structures and then use fixture free laser etching of the keytops. This contrasts with present techniques which call for doing the keys individually, and only then placing them on the chimneys.

Fifth, not only can the dome switch be formed from a single piece of silicone, it may be made in a single step by placing the hard plastic buttons and the carbon pills in the silicone mold, and then injecting the silicone in a single, insert molding step. This eliminates subsequent assembly requiring that the carbon pill and the buttons be added afterwards. Obvious cost benefits can be realized from such a single step process.

Finally, the silicone can be made to completely cover the PCB and be provided with a wrap around edge. In such case, the silicone completely protects the upper surface of the PCB, and the whole assembly becomes impervious to dust, dirt, cleaning fluids, moisture and other contaminants. This contrasts with prior art "guides and ribs" switch structure which may bind and malfunction due to such causes.

While the present invention has been disclosed with reference to certain preferred embodiments, these should not be considered to limit the present invention. One skilled in the art will readily recognize that variations of these embodiments are possible, each falling within the scope of the invention, as set forth in the claims below.

What is claimed is:

1. A dome switch assembly comprising:

a printed circuit board having an upper face carrying a pair of spaced apart electrical contacts; and a dome member mounted on said printed circuit board, said dome member comprising:

a hollow chimney structure having a substantially rigid upper portion terminating in an opening formed at a top end thereof, a collapsible portion connected to said upper portion and arranged to deform when said upper portion is depressed, and a substantially rigid lower portion connected to said collapsible portion;

a contact post having a first end fixed to said upper portion and a second end provided with electrical contact forming means; and a reflector fixed to said contact post and arranged to deflect light arriving from a first direction, said light being deflected through a passage formed in said hollow chimney structure and towards said opening, wherein said contact post and electrical contact forming means are arranged to electrically connect said pair of spaced apart electrical contacts, when said upper portion is depressed.

2. The assembly of claim 1, further comprising a key secured to the upper portion and covering said opening, said key having a translucent graphic area formed on a top surface thereof, said key arranged to depress the upper portion and cause said electrical contact forming means to complete an electrical connection between said pair of spaced apart contacts, when the key is pressed; and wherein the chimney structure, the contact post and the reflector are arranged such that light deflected by said reflector passes through said opening and said translucent graphic area, even when the key is pressed.

3. The assembly of claim 2, further comprising a light source mounted on the printed circuit board and arranged to illuminate the reflector, and a light duct extending between the light source and the reflector.

4. The assembly of claim 1, further comprising:

a light source arranged to illuminate the reflector.

5. The assembly of claim 4, further comprising:

a light duct extending between the light source and the reflector.

6. The assembly of claim 5, wherein said upper portion, said collapsible portion, said lower portion and said light duct are integrally formed from a single piece of silicone.

7. The assembly of claim 4, wherein said dome member comprises a plurality of chimney structures, each having an associated contact post and reflector, and wherein said light source is arranged to illuminate the reflectors.

8. The assembly of claim 7, further comprising:

individual light ducts extending between the light source and each of the reflectors.

9. The assembly of claim 7, wherein each of said lights ducts is integrally formed with the lower portion of an associated chimney structure.

10. A dome member comprising:

a hollow chimney structure having a substantially rigid upper portion terminating in an opening formed at a top end thereof, a collapsible portion connected to said upper portion and arranged to deform when said upper portion is depressed, and a substantially rigid lower portion connected to said collapsible portion;

a contact post having a first end fixed to said upper portion and a second end provided with electrical contact forming means; and a reflector fixed to said contact post and arranged to deflect light arriving from a first direction, said light being deflected through a passage formed in said hollow chimney structure and towards said opening.

11. The dome member of claim 10, further comprising a key secured to the upper portion and covering said opening, said key having a translucent graphic area formed on a top surface thereof, said key arranged to depress the upper portion, when the key is pressed; and wherein the chimney structure, the contact post and the reflector are arranged such that light deflected by said reflector passes through said opening and said translucent graphic area, even when the key is pressed.

12. The dome member of claim 11, further comprising a light duct integrally formed with the lower portion of the chimney structure.

13. The dome member of claim 10, further comprising a light duct integrally formed with the lower portion of the chimney structure.

14. The dome member of claim 10, wherein said dome member comprises a plurality of chimney structures, each having an associated contact post and reflector.

15. The dome member of claim 14, further comprising a separate light duct connected to each of the chimney structures.

16. The dome member of claim 15, wherein each light duct is integrally formed with its associated chimney structure.

17. The dome member of claim 16, wherein the light ducts converge.

18. The dome member of claim 17, where the number of chimney structures is four.

19. The dome member of claim 10, wherein the upper portion, collapsible portion, and lower portion are integrally formed from a single piece of silicone.

20. The dome member of claim 19, further comprising a light duct integrally formed with said lower portion.

21. The dome member of claim 19, wherein said dome member comprises a plurality of chimney structures, each having an associated contact post and reflector.

22. The dome member of claim 21, further comprising a separate light duct connected to each of the chimney structures.

23. A dome switch assembly comprising:

a printed circuit board having an upper face carrying a pair of spaced apart electrical contacts; and a dome member mounted on said printed circuit board, said dome member comprising:

a hollow chimney structure having a substantially rigid upper portion a collapsible portion connected to said upper portion and arranged to deform when said upper portion is depressed, and a substantially rigid lower portion connected to said collapsible portion;

a contact post having a first end fixed to said upper portion and a second end provided with electrical contact forming means; and a reflector fixed to said contact post and arranged to deflect light arriving from a first direction, up into said hollow chimney structure, wherein said contact post and electrical contact forming means are arranged to electrically connect said pair of spaced apart electrical contacts, when said upper portion is depressed.

24. A dome member comprising:

a hollow chimney structure having a substantially rigid upper portion, a collapsible portion connected to said upper portion and arranged to deform when said upper portion is depressed, and a substantially rigid lower portion connected to said collapsible portion;

a contact post having a first end fixed to said upper portion; and a reflector fixed to said contact post and arranged to deflect light arriving from a first direction, said light being deflected through a passage formed in said hollow chimney structure;

wherein walls of said collapsible portion are thinner than walls of both said rigid upper and said rigid lower portions.

25. A dome member comprising:

a hollow chimney structure having a substantially rigid upper portion, a collapsible portion connected to said upper portion and arranged to deform when said upper portion is depressed, and a substantially rigid lower portion connected to said collapsible portion;

a contact post having a first end fixed to said upper portion;

a light duct connected to said lower portion; and a reflector fixed to said contact post and arranged to deflect light coming from the light duct, said light being deflected through a passage formed in said hollow chimney structure;

wherein said rigid upper portion, said collapsible portion said rigid lower portion and said light duct are all integrally formed as a single piece of silicone.

26. A dome member comprising:

a plurality of hollow chimney structures, each hollow chimney structure having a substantially rigid upper portion, a collapsible portion connected to said upper portion and arranged to deform when said upper portion is depressed, and a substantially rigid lower portion connected to said collapsible portion;

a contact post having a first end fixed to said upper portion of each hollow chimney structure;

a light duct connected to said lower portion of each hollow chimney structure; and a reflector fixed to each of said contact posts, said reflector arranged to deflect light coming from a corresponding light duct into a passage formed in said hollow chimney structure;

wherein the light ducts converge.

* * * * *